US006195065B1

(12) United States Patent
Hung et al.

(10) Patent No.: US 6,195,065 B1
(45) Date of Patent: Feb. 27, 2001

(54) ANTENNA WITH VARIABLE GEOMETRY

(75) Inventors: Frédéric Ngo Bui Hung, Franconville; William Rebernak, Saint Denis; Sylvain Kretschmer, Paris, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/355,918

(22) PCT Filed: Feb. 6, 1998

(86) PCT No.: PCT/FR98/00232

§ 371 Date: Aug. 9, 1999

§ 102(e) Date: Aug. 9, 1999

(87) PCT Pub. No.: WO98/35402

PCT Pub. Date: Aug. 13, 1998

(30) Foreign Application Priority Data

Feb. 7, 1997 (FR) ..... 97 01428
Jan. 13, 1998 (FR) ..... 98 00245

(51) Int. Cl.[7] ..... H01Q 3/24
(52) U.S. Cl. ..... 343/876; 343/745
(58) Field of Search ..... 343/700 MS, 829, 343/830, 745, 846, 876, 875, 853, 815, 750; 250/211 R, 227.23, 551; 455/121, 123, 129; H01Q 9/00, 11/00, 3/24

(56) References Cited

U.S. PATENT DOCUMENTS

| | | | | |
|---|---|---|---|---|
| 3,129,386 | * | 4/1964 | Daly | 325/174 |
| 4,564,843 | * | 1/1986 | Cooper | 343/745 |
| 4,751,513 | * | 6/1988 | Daryoush et al. | 343/802 |
| 4,763,126 | * | 8/1988 | Jawetz | 340/985 |
| 4,924,238 | * | 5/1990 | Ploussios | 343/802 |
| 5,093,668 | * | 3/1992 | Sreenivas | 342/374 |
| 5,293,172 | * | 3/1994 | Lamberty et al. | 343/701 |
| 5,367,310 | * | 11/1994 | Warnagiris | 343/745 |
| 5,656,931 | * | 8/1997 | Lau et al. | 324/522 |

FOREIGN PATENT DOCUMENTS

| | | | |
|---|---|---|---|
| 10 49 556 | * | 4/1971 | (DE) . |
| 0 428 229 A1 | * | 5/1991 | (EP) . |

* cited by examiner

*Primary Examiner*—Don Wong
*Assistant Examiner*—Tho Phan
(74) *Attorney, Agent, or Firm*—Oblon, Spivak, McClelland, Maier & Neustadt, P.C.

(57) ABSTRACT

A variable geometry antenna including first and second conducting sections and electrically separated by a gap, and a sliding switching module assigned to the gap. The sliding switching module includes a mechanical relay, a moveable rod having a first end secured to a conducting piece included in the mechanical relay and configured to slide parallel to the first and second conducting sections so as to couple the first and second conducting sections, and a control mechanism.

11 Claims, 2 Drawing Sheets

ANTENNA WITH VARIABLE GEOMETRY

BACKGROUND OF THE INVENTION

1. Field of the Invention

The present invention relates to antennas whose dimensions may be modified so as to modify their radioelectric characteristics with the objective, generally, of making them work, by choice, in one out of several frequency bands; these antennas are mainly used at frequencies below 1 GHz.

2. Discussion of the Background

Antennas are known which comprise at least one radiating element having variable electrical length, which is constructed from an array of n, with n an integer greater than 1, conducting sections separated by switching modules designed to electrically link together all or some of the sections. Onwards of that of its two ends where it is fed, the array constitutes a radiating element which is made, by choice, of 1, 2, . . . n sections. This is the way in which, in particular, variable geometry unipole antennas are constructed.

In certain cases the switching modules consist simply of fixing means, generally a screw and a nut carried respectively by the opposite ends of the sections to be joined electrically. When joining is to be controlled remotely for reasons of ease and/or speed of implementation, it is a known practice to use a switching module of the electrical relay type and linking means made of two electrical wires for controlling the relay; the presence of these wires which are radioelectrically insulated from the conducting sections in a more or less effective manner, limits the performance of the antenna and this limitation is all the greater when the antenna caters for high powers or high voltages, as is the case with antennas operating with decameter waves.

It should also be noted that it is known practice, through U.S. Pat. No. 4,728,805, to construct antennas from a three-dimensional matrix whose rows are made of conducting segments with, at the intersections of the rows, photoconducting elements which provide connections between segments when they are illuminated. On account of the photoconductors available on the market, this technique can only be used with low-power antennas and, moreover, these photoconductors must be permanently illuminated in order to be maintained in the on state.

SUMMARY OF THE INVENTION

The objective of the present invention is to avoid the aforementioned drawbacks in antennas whose geometry can be adjusted remotely.

This is achieved by virtue of a remote control which implements linking means which do not disturb the radioelectric operation of the antenna and which are associated with switching means which may be chosen so as to cater for high powers or high voltages.

According to the present invention this is implemented by antennas such as defined on the one hand in the first aspect and on the other hand in claim 2.

The antenna according to claim 1 comprises switching sections comprising an electromechanical relay with two stable states which is controlled by two photovoltaic devices which are themselves respectively controlled by two fibre optic cables. In relation to this antenna should be noted the U.S. Pat. No. 5,293,172 which describes an antenna in which antenna sections are linked together with switching modules comprising an electronic relay with two states, which is controlled by a photovoltaic device which is itself controlled by a fibre optic cable; this antenna has, in particular, two drawbacks:—the relay does not make it possible to pass high powers—to maintain one of the two states the photovoltaic device must be permanently illuminated.

The antenna according to the second aspect comprises antenna sections linked together by switching modules comprising a conducting piece which is made to slide along the antenna by an insulating rod, thus making it possible to couple two sections of the antenna; in this antenna which is located above an earth plane, the insulating rod traverses the earth plane and thus it is possible to manoeuvre the rod from beneath the earth plane, thereby avoiding disturbance to the operation of the antenna. In relation to this antenna should be noted patent application EP-A-0 428 229 which describes an antenna made of antenna sections with, for linking together two consecutive sections of the antenna, a bistable electromechanical relay "incorporated" into the gap between the two relevant sections; this relay comprises contacts having two positions, a rod for moving the contacts and two devices for driving the rod which are controlled from signals tapped off from the antenna with the aid of wires; this antenna comprises, for linking two sections, certain elements which are comparable to those of the second aspect but on the one hand it does not comprise the "conducting piece which slides" and which permits large powers and high voltages and on the other hand all its constituent elements are incorporated into the gap between the relevant sections and therefore affect the operation of the antenna in contradistinction to what occurs in the antenna according to the second aspect where the second end of the insulating rod is located under an earth plane so that the means for driving the insulating rod can be arranged under this earth plane.

The present invention will be better understood and other characteristics will become apparent with the aid of the following description and of the figures relating thereto which represent:

DETAILED DESCRIPTION OF THE PREFERRED EMBODIMENTS

Figure 1:
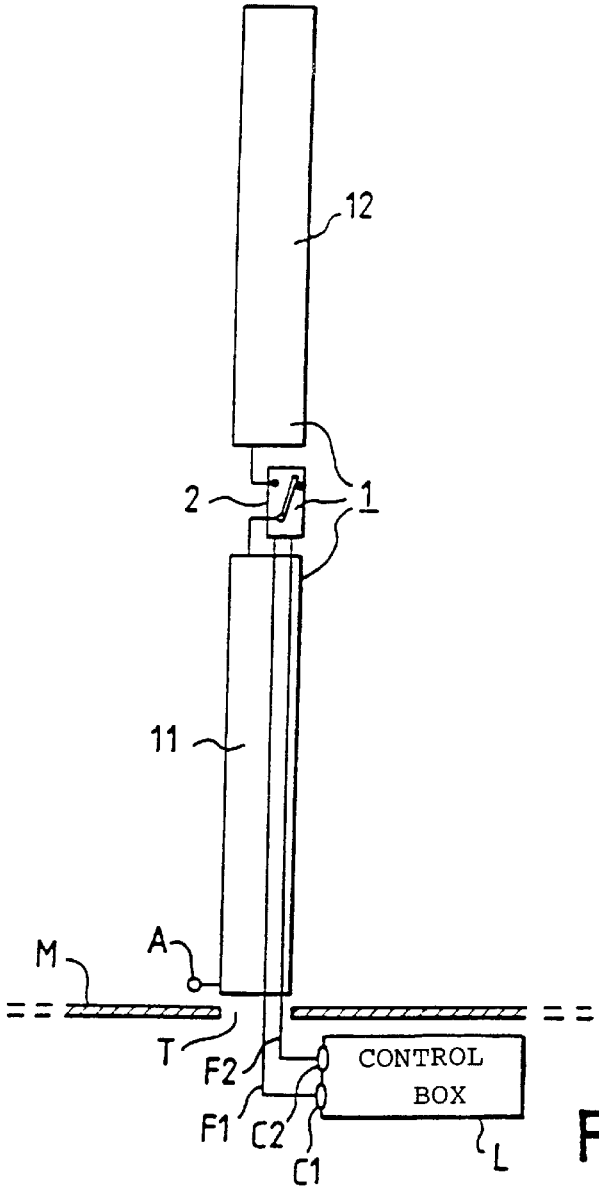
FIG. 1 is a diagrammatic view of an antenna according to the invention.

FIG. 1 is a sectional diagrammatic view of an antenna according to the invention. This is a unipole antenna, also referred to as a whip antenna. This antenna has variable geometry and comprises a radiating part 1 and an earth plane M. The radiating part comprises two aligned conducting sections 11, 12, separated by a gap with, associated with this gap, a switching module, 2, which will be described in greater detail with the aid of FIG. 2; this radiating part is arranged perpendicularly to the earth plane M, level with a hole T drilled in the earth plane, and is located wholly above the earth plane M. The conducting sections 11, 12 are hollow cylinders whose opposite ends are electrically linked respectively to two ports of the switching module 2. Two optical fibers F1, F2, that is to say electrically insulating light-conductors which are transparent to radio waves, respectively link two optical connectors C1, C2 located under the earth plane M, to the switching module 2; these fibers pass through the hole T and then into the section 11, exploiting the fact that this section is a hollow cylinder which is open at its two ends. A control box, L, comprising a laser power source, makes it possible to send a light pulse, by choice, on the optical connector C1 or on the optical connector C2.

The transmit/receive port of the antenna is made between the earth plane M and a terminal A located on the conducting section 11 in the immediate vicinity of the earth plane.

To simplify the drawing and since they contribute nothing to the understanding of the invention, the fixing means which mechanically link together all the pieces of FIG. 1 have not been represented; the same holds in respect of the other figures of this document.

The antenna according to FIG. 1 is intended to work between 1.5 and 30 MHz, in a low band 1.5–7.5 MHz and in a high band 7.5–30 MHz. To do this, the length of each of the sections 11, 12 has been taken to be substantially equal to 5 meters and, by virtue of the switching module 2, the conducting section 12 may or may not be connected to the section 11, this giving the antenna a radioelectric height of 10 meters for the low band and of 5 meters for the high band.

Figure 2:
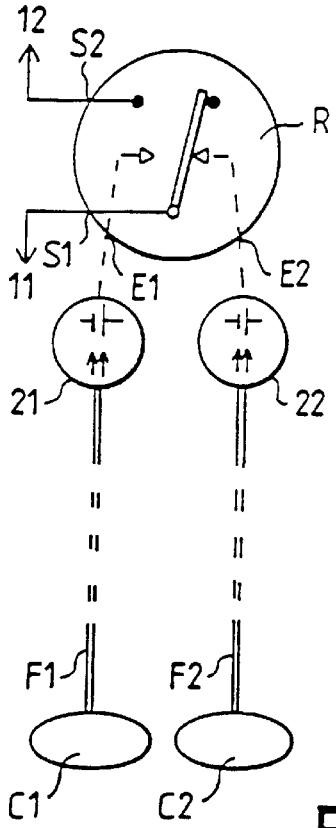
FIG. 2 is a more detailed view of a part of the antenna according to FIG. 1, and FIGS. 3, 4, 5*a*, 5*b*, 6*a*, 6*b* are other diagrammatic views relating to antennas according to the invention.

FIG. 2 is a diagrammatic view of the switching module 2 of FIG. 1. This module comprises a relay R and two photovoltaic cells 21, 22.

The relay R is a bi-stable electromechanical relay whose two stable states are respectively controlled, by current pulses, from two inputs E1, E2. The two stable states correspond respectively to the opening and to the closing of an internal contact in the relay. The terminals S1, S2 of this contact constitute the ports for utilizing the relay; they are respectively connected to the sections 11 and 12 represented in FIG. 1 in such a way as to make it possible, as indicated earlier, to effect or otherwise an electrical link between these two sections. The relay R can consist of a REED SUPERDIL type relay marketed by the CELDUC company under the reference G31R3210.

The optical fibers F1, F2 terminate respectively on the light inputs of the photovoltaic cells 21, 22 and the current outputs of these cells are respectively linked to the inputs E1, E2 of the relay R.

In order for the two sections 11 and 12 represented in FIG. 1 to be connected in series, so as to constitute a 10 meter aerial, a light pulse originating, as was indicated previously, from the box L is routed via the optical connector C1 and the optical fiber F1 to the photovoltaic cell 21; the current pulse resulting therefrom at the output of the photovoltaic cell 21 causes the contact of the relay R to close or leaves it in the closed position depending on whether this contact was in the open or closed position before the arrival of the pulse.

In the same way, when it is desired to operate with a 5 meter aerial, that is to say with only the section 11 represented in FIG. 1, a light pulse is sent from the box L to the photovoltaic cell 22; the current pulse resulting therefrom at the output of the photovoltaic cell 22 causes the contact of the relay R to open or leaves it in the open position depending on whether this contact was in the closed or open position before the arrival of the pulse.

The antenna just described with the aid of FIGS. 1 and 2, using optical fibers instead of electrical conductors for remotely controlling the switching module between the conducting sections 11, 12, avoids the coupling which would be set up between the section and the electrical conductors.

It should be noted that it is for the sake of aesthetics that it has been chosen to exploit the fact that the conducting section 11 is hollow in order to pass the optical fibers through it and that, without any manifest drawback from the operational standpoint, the fibers may be placed outside the conducting section and in particular on the conducting section; in the case where the conducting section is solid, this would be the only possible way to pass the fibers.

Figure 3:
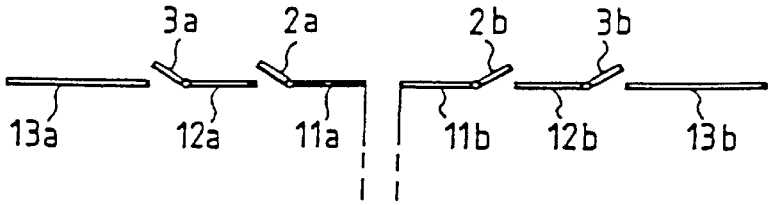

FIG. 3 is the simplified diagram of another antenna according to the invention. Here, the antenna is of the horizontal dipole type and each of the two arms of the dipole comprises three aligned conducting sections separated from one another by switching modules 2*a*, 3*a*, 2*b*, 3*b*. These switching modules represented diagrammatically by a simple contact are, in the antenna which has served as an example in the present description, of the same type as the switching module 2 of FIGS. 1 and 2. Also, still in the antenna under consideration, optical fibers, not represented, serve for the control of these modules; they run alongside the arms of the dipole, coming from the middle of the dipole and terminating on the various modules.

The antenna which has served as an example for the drawing according to FIG. 3 is an antenna designed for ionospheric-reflection Hertzian links in the 1.5–12 MHz band over a distance of from 0 to 500 km. When the four switching modules are open, the antenna has an electrical span of 15 meters, only the sections 11*a*, 11*b* being operational. The antenna is then designed to operate between 6 and 12 MHz. When the modules 2*a*, 2*b* are closed and the modules 3*a*, 3*b* open, the electrical span is raised to 30 meters and the antenna is designed to operate between 3 and 6 MHz. Also, when the four switching modules are closed, the electrical span is 60 meters and the antenna is designed to operate between 1.5 and 3 MHz.

The invention, within the context of the use of optical fibers, is not limited to the examples described or mentioned; thus, the switching modules may comprise a relay with one stable state and one unstable state; in this case a single optical fiber and a single photovoltaic cell are sufficient and the unstable state is controlled by sending a continuous luminous flux through the optical fiber throughout the time for which this unstable state is to be maintained; the return to the stable state is achieved by halting the sending of the luminous flux. This way of proceeding admittedly has the advantage of reducing the number of elements for carrying out switching, but has the drawback of requiring, for maintaining the unstable state, a continuous luminous flux, that is to say continuous energy and possibly a more powerful light source than with a relay having two stable states controlled by pulses.

A third type of switching module can be used; it comprises a relay with two stable states but with a single input, and this relay, of counter type, changes a state with each pulse received on its input. As with the module described in the previous paragraph, a single optical fiber and a single photovoltaic cell are required per module and, as with the module described with the aid of FIG. 2, control is achieved by pulses. However, this module has the drawback of requiring, for the operator, specific means for signalling the open or closed state of the relay; thus, with the previous two types of modules the remote control instructions for the open and closed states are distinct and either the last remote control instruction can therefore be easily signalled, or the desired remote control instruction can be performed for all useful purposes, as a safety measure, in the case of a doubt regarding the state of the relay; matters are different with a relay of counter type since, in the event of a doubt regarding the state of the relay, it is not possible to proceed to a safety control and since it is therefore necessary, for example, knowing the state of the relay at a given moment, to employ a means of counting modulo 2 for the remote control instructions performed onwards of this given moment.

Likewise, the relay of a switching module may be of electronic type.

As far as antennas comprising several switching modules are concerned, it is possible to construct some of these modules according to the invention and others according to the prior art, for example by linking certain conducting sections by fixing means of the screw/nut type.

As regards to the photovoltaic cells alluded to above, they may be replaced by batteries of photovoltaic cells, while the optical fibers may be replaced by optical cables comprising several optical fibers in parallel.

For the relays of the modules, rather than using ordinary "open/closed" relays it is even possible to use relays which, in one of their two states, or even in both their states, switch an impedance, for example: infinite impedance in the open state and impedance Z in the closed state.

It is possible to use solid tubes to construct the radiating conducting sections, insofar as the optical fibers are routed outside the antenna.

In what follows, other variants of the invention will be described but these variants no longer come within the context of the use of optical fibers to act, through photovoltaic devices, on the electrical relay of a module. They come within the context of the use of rods made from an insulating material which is transparent to radio waves and which are intended for controlling the switching of mechanical relays placed between two antenna sections; the expression mechanical relay is of course understood to comprise mechanically controlled relays which are, however, intended for effecting electrical links between sections.

Figure 4:
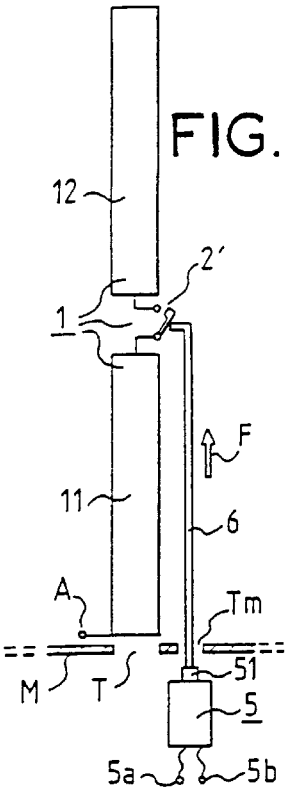

FIG. 4 is a sectional diagrammatic view of an antenna which differs from the antenna according to FIG. 1 only through the switching module and the device for controlling this module. Thus, FIG. 4 shows a variable-geometry unipole antenna with:—the same radiating part 1 made of two aligned conducting sections 11, 12 separated by a gap with, associated with this gap, a switching module 2' consisting of a relay with two states, open/closed, of the mechanical breaker type,—an earth plane M arranged like that of FIG. 1—and a transmit/receive port between the earth plane and a terminal A located at the bottom of the conducting section 11.

In this antenna the control of the mechanical breaker 2' is provided for by an assembly consisting of a slugged coil 5, whose moveable part 51 is extended by a rod 6 made from an insulating material which is transparent to electromagnetic waves. The coil is located under the earth plane M traversed by the rod 6 through a hole Tm. On the opposite side from the coil 5 the rod is bent at a right angle and comes into contact with the blade of the breaker 2'. In FIG. 4 the breaker 2' is in the open position and the moveable part 51 is in the home position; when, through an electrical control instruction applied to the ports 5*a*, 5*b* of the coil 5, the moveable part is deployed, the rod 6 undergoes an upward translation, as indicated by the arrow F, and, by pushing the moveable blade of the breaker 2', closes this breaker and, therefore, connects the section 12.

Figure 5A:
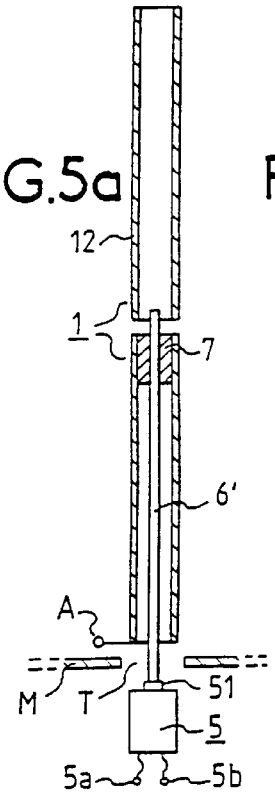
Figure 5B:
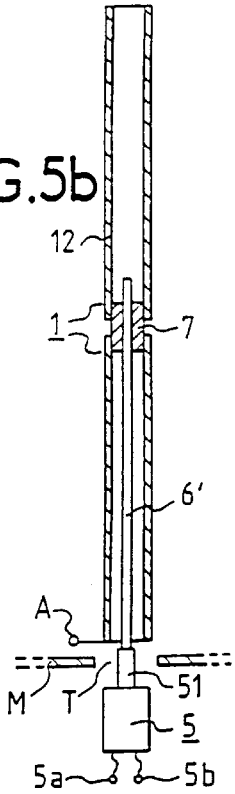

FIGS. 5*a*, 5*b* are sectional diagrammatic views which correspond to a variant embodiment of the antenna according to FIG. 4; in this embodiment, still with the same type of antenna, the switching of the conducting section 12 is achieved by virtue of a switching module consisting of a conducting sleeve 7 which can slide inside the hollow sections 11 and 12, against that part of these sections located in the vicinity of the gap which separates them; this sleeve thus plays a role of mechanical relay with two states, open/closed, between the hollow sections 11 and 12. Here again a slugged coil, 5, is used; it is located under the earth plane M, plumb with the hole T drilled in the earth plane under the radiating part 1. The moveable part 51 of the coil 5 is extended by a rod 6'. This rod is a straight rod which penetrates, at its upper end, into the sleeve 7 in which it is locked. Depending on the instruction applied to the terminals 5*a*, 5*b* of the coil 5, the moveable part 51 is in the home or deployed position as represented in FIGS. 5*a* and 5*b* respectively. In the position represented in FIG. 5*a* the conducting sleeve 7 does not make contact with the section 12, so that the antenna is designed to operate with this section alone as radiating element. In the position represented in FIG. 5*b* the conducting sleeve 7 makes contact with both sections 11 and 12 and, this time, the antenna is designed to operate with both sections 11 and 12 as radiating elements.

Figure 6A:
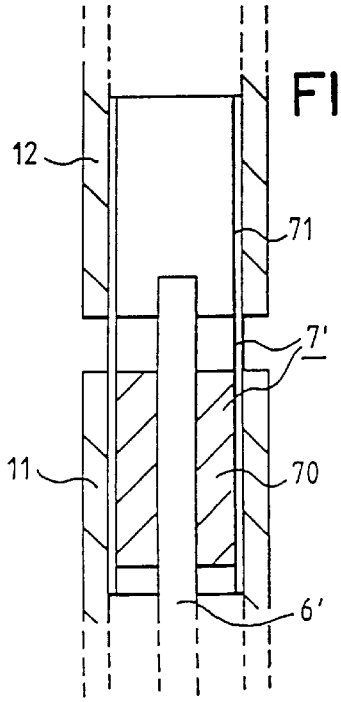
Figure 6B:
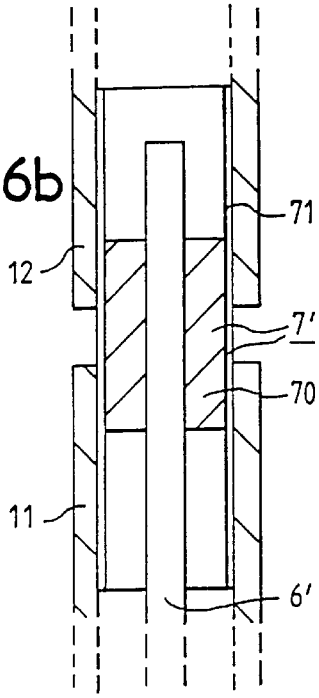

FIGS. 6*a*, 6*b* are sectional diagrammatic views which correspond to a variant embodiment of the antenna according to the invention.

In the embodiment according to FIGS. 6*a*, 6*b* a switching module 7' is used which, instead of effecting a connection through the conducting element between two radiating sections, effects a connection by capacitive coupling.

In its basic embodiment this antenna does not differ from the antenna according to FIGS. 5*a*, 5*b* other than through the switching module 7'; therefore is has been deemed to be preferable, so as to clearly highlight the distinction, to show, in FIGS. 6*a* 6*b*, only that part of the antenna located in the vicinity of the switching module.

The switching module 7' comprises two sleeves: an inner sleeve 70 and an outer sleeve 71. The inner sleeve is a conducting sleeve; an insulating rod, 6', identical to the rod 6' according to FIGS. 5*a*, 5*b* penetrates into the sleeve 70, at its upper end, and is locked inside the sleeve. The outer sleeve, of small thickness, is a dielectric sleeve locked, at its lower part, inside a hollow conducting section 11 and, at its upper part, inside a hollow conducting section 12.

The inner sleeve 70 slides in the outer section 71. In FIG. 6*a* the rod 6' is represented in the bottom position, with the sleeve 70 contained wholly within the section 7; in this position the module 7' does not effect electrical connection between the sections 11 and 12. In FIG. 6*b* the rod 6' is represented in the top position, with the sleeve 70, the bottom part of which is contained in the section 11 and the top part of which is contained in the section 12. The facing portions of the section 11 and of the sleeve 70 on the one hand, and of the section 12 and of the sleeve 70 on the other hand, respectively constitute the plates of two capacitors. The sections 11 and 12 are thus linked by these two capacitors arranged in series. The dielectric sleeve 71 allows a great reduction in wear due to sliding since it eliminates the metal-on-metal rubbing of the embodiment according to FIGS. 5*a*, 5*b*.

It should be noted that, for the same frequencies of use of the antenna, the section 12 of FIGS. 6*a*, 6*b* has a greater length than that of the section 12 of the antenna according to FIGS. 5*a*, 5*b*; this is due to the capacitance contributed by the switching module, which capacitance brings about a decrease in the electrical length of the antenna.

For these antennas controlled by insulating rod the invention is not limited to the examples described, and thus it may be applied to the case of more than two aligned radiating sections; the insulating rods for controlling the switching modules may then be arranged one beside the other or constructed in a concentric manner.

In the case where the insulating rods are side by side and where the control of switching is achieved through the inside of the radiating sections, the conducting sleeves of the modules will have to be drilled with eccentric holes to allow the passage of the insulating rods for controlling the modules placed above them. Moreover, the insulating rods will be curved so that they can be controlled translationally independently of one another, so as to pass the lower modules through the eccentric holes and so as to be centred during their penetration into their respective modules.

In the case where the rods are concentric they must, at least all except one, comprise an off-centered piece, at their lower end, to enable them to be controlled translationally independently of one another.

The translational control instructions for the insulating rods may be achieved in various ways and, in particular, manually.

The conducting sections may be solid when the insulating rods are outside as in the case of FIG. 4.

The switching modules may consist of sleeves which, instead of penetrating into the conducting sections, surround these conducting sections; however, here again the switching module is arranged level with the gap between the two sections which it switches and switching is effected by sliding the conducting sleeve along the sections.

What is claimed is:

1. A variable geometry antenna, comprising:

first and second conducting sections electrically separated by a gap;

a moveable rod having a first end secured to a conducting piece configured to slide parallel to the first and second conducting sections so as to couple the first and second conducting sections; and a control mechanism.

2. The antenna according to claim 1, further comprising:

a sliding switching module assigned to said gap, the said sliding switching module comprising:

a mechanical relay comprising the conducting piece, the moveable rod, and the control mechanism.

3. The antenna according to claim 1, wherein the first and second conducting sections comprise a plurality of n conducting sections to form an array, n being greater than 1.

4. The antenna according to claim 3, wherein the n conducting sections are electrically separated by n-1 gaps, n-1 switching modules respectively assigned to the n-1 gaps, with at least one of the switching modules being the said sliding switching module.

5. The antenna according to claim 1, wherein the moveable rod comprises an electrically insulating material transparent to electrical waves.

6. The antenna according to claim 1, wherein the first and second conducting sections comprise hollow cylinders and the moveable rod having the conducting piece slides inside the hollow cylinders.

7. The antenna according to claim 1, wherein the first and second conducting sections are located above an earth plane (M) of the antenna and the second end of the rod is located underneath the earth plane (M).

8. The antenna according to claim 1, wherein the control mechanism couples the first and second conducting sections by moving the rod such that the conducting piece slides directly over said gap and contacts both the first and second conducting sections.

9. The antenna according to claim 1, wherein the mechanical relay comprises:

a dielectric sleeve disposed in the vicinity of the gap and connecting the first and second portions.

10. The antenna according to claim 9, wherein the conducting piece slides while bearing on the dielectric sleeve.

11. The antenna according to claim 1, wherein the control mechanism comprises a slugged coil having a moveable part connected to the moveable rod.

* * * * *